US010920332B2

(12) United States Patent
Balaraju et al.

(10) Patent No.: US 10,920,332 B2
(45) Date of Patent: Feb. 16, 2021

(54) PROCESS FOR THE PREPARATION OF CORROSION RESISTANCE SEALED ANODIZED COATINGS ON ALUMINUM ALLOY

(71) Applicant: COUNCIL OF SCIENTIFIC & INDUSTRIAL RESEARCH, New Delhi (IN)

(72) Inventors: Jayam Nagabushan Balaraju, Karnataka (IN); Govindaraj Yoganandan, Karnataka (IN)

(73) Assignee: Council of Scientific and Industrial Research, New Delhi (IN)

( * ) Notice: Subject to any disclaimer, the term of this patent is extended or adjusted under 35 U.S.C. 154(b) by 202 days.

(21) Appl. No.: 15/543,153

(22) PCT Filed: Jan. 6, 2016

(86) PCT No.: PCT/IN2016/050003
§ 371 (c)(1),
(2) Date: Jul. 12, 2017

(87) PCT Pub. No.: WO2016/116949
PCT Pub. Date: Jul. 28, 2016

(65) Prior Publication Data

US 2018/0002825 A1 Jan. 4, 2018

(30) Foreign Application Priority Data

Jan. 19, 2015 (IN) ..... 159/DEL/2015

(51) Int. Cl.

| | |
|---|---|
| ***C25D 11/02*** | (2006.01) |
| ***C25D 11/16*** | (2006.01) |
| ***C25D 11/18*** | (2006.01) |
| ***C25D 11/08*** | (2006.01) |
| ***C25D 11/10*** | (2006.01) |
| ***C25D 11/24*** | (2006.01) |
| ***C23G 5/028*** | (2006.01) |
| ***C25F 3/04*** | (2006.01) |

(52) U.S. Cl.
CPC ..... *C25D 11/08* (2013.01); *C23G 5/02874* (2013.01); *C25D 11/10* (2013.01); *C25D 11/16* (2013.01); *C25D 11/246* (2013.01); *C25F 3/04* (2013.01)

(58) Field of Classification Search
CPC ..... C23C 28/00; C23D 11/02; C25D 11/16; C25D 11/18
USPC ..... 205/199, 203, 210
See application file for complete search history.

(56) References Cited

U.S. PATENT DOCUMENTS

| | | | | |
|---|---|---|---|---|
| 2,882,134 | A * | 4/1959 | Spring | C23F 1/36 216/102 |
| 3,376,193 | A | 4/1968 | Barkman | |
| 6,485,557 | B1 * | 11/2002 | Swiler | C01G 45/00 106/474 |
| 2002/0157961 | A1 * | 10/2002 | Dattilo | C25D 11/06 205/328 |
| 2011/0300400 | A1 * | 12/2011 | Tomita | B81C 1/00111 428/605 |

FOREIGN PATENT DOCUMENTS

| | | | | |
|---|---|---|---|---|
| CN | 102899611 | A * | 1/2013 | C23C 14/06 |

OTHER PUBLICATIONS

Balaraju et al., "Effect of Mn/Mo Incorporated Oxide Layer on the Corrosion Behavior of AA 2024 Alloy," Corrosion Science (2011), vol. 53, pp. 4048-4092. (Year: 2011).*
Stevenson, Jr., "Anodizing," ASM Handbook, vol. 5: Surface Engineering, © 1994, pp. 482-493. (Year: 1994).*
Balaraju et al., "Effect of Mn/Mo Incorporated Oxide Layer on the Corrosion Behavior of AA 2024 Alloy," Corrosion Science (2011), vol. 53, pp. 4084-4092. (Year: 2011).*
Hamdy et al., "Improving the Corrosion Protection of AA6061 T6—10% Al2O3 Using New Surface Pre-Treatments Prior to Fluoropolymer Coatings," Surface and Coatings Technology (2002), vol. 155, pp. 184-189. (Year: 2002).*
International Search Report issued in connection with PCT International Application No. PCT/IN2016/050003, dated Jul. 25, 2017.
Written Opinion of the International Searching Authority issued in connection with PCT International Application No. PCT/IN2016/050003, dated Dec. 12, 2016.
Balaraju, J.N., et al., "Effect of Mn/Mo incorporated oxide layer on the corrosion behavior of AA 2024 allow" Corrosion Science, Aug. 6, 2011, vol. 53, No. 12, pp. 4084-4092, Oxford, GB.
Garcia-Rubio, M., et al., "Influence of molybdate species on the. tartaric acid/sulphuric acid anodic films grown on AA2024 T3 aerospace alloy", Corrosion Scinece, Oxford, GB, 2009.

* cited by examiner

*Primary Examiner* — Edna Wong
(74) *Attorney, Agent, or Firm* — John P. White

(57) ABSTRACT

Development of an alternative process to conventional toxic chromic acid anodization (CAA) with equivalent corrosion resistance is a challenging task. The present invention provides a chromate free process for the manufacture of corrosion resistant sealed anodized coating for long term corrosion resistance of aerospace grade aluminum alloy. This method includes the steps of cleaning, chemical etching, anodizing in Tartaric-Sulphuric acid electrolyte followed by dipping the specimen in the sealing bath containing at least two water soluble either Mn and Mo or Mn and V oxyanions as corrosion inhibitors and a sufficient amount of alkali metal ion based nitrates at a temperature range between 60 and 80° C. for about 20 to 40 minutes at a pH range of 7 to 9. The sealed anodic coatings developed from this invention showed improved corrosion resistance in neutral 5% NaCl fog environment for greater than 2000 h of exposure. The sealed anodic coatings developed by this invention also showed self-healing protection in NaCl environment.

4 Claims, No Drawings

PROCESS FOR THE PREPARATION OF CORROSION RESISTANCE SEALED ANODIZED COATINGS ON ALUMINUM ALLOY

CROSS-REFERENCE TO RELATED APPLICATIONS

This application is a § 371 national stage of PCT International Application No. PCT/IN2016/050003, filed Jan. 6, 2016, claiming priority of Indian Patent Application No. IN 159/DEL/2015, filed Jan. 19, 2015, the contents of each of which are hereby incorporated by reference into the application.

FIELD OF THE INVENTION

Present invention relates to a process for the preparation of corrosion resistant sealed anodized coatings on aluminum alloy.

Present invention more particularly relates to a process for the manufacture of chromate free Manganese (Mn) oxyanion based sealed anodized coating for corrosion protection of aerospace aluminum alloys.

BACKGROUND OF THE INVENTION

Aerospace grade aluminum alloys (AA2024 and AA7075) have been widely used in various parts of the aircraft structure such as fuselage, wing skin, and stringers, fuselage frames, floor walls, etc. due to their high strength. However, they exhibit poor corrosion resistance in marine environment due to the presence of Cu/Zn rich intermetallic particles. In order to mitigate the corrosion, aluminum oxide layers are conventionally formed by anodizing procedures involving the use of baths containing chromic acid or phosphoric acid, sulphuric acid, aliphatic water soluble carboxylic acids, or mixtures of these acids. In general, these anodized oxide layers contain a porous outer layer and a non porous inner layer. Hence, anodized aluminum surface is usually sealed to render the penetration of corrosive species which can adversely affect the alloy substrate. Therefore, a high quality sealing is required in aggressive corrosive environment like in marine application. Over five decades, a high performance sealing for anodized aluminum alloy is obtained by hexavalent chromium based baths. The coating based on hexavalent chromium provides excellent paint adhesion and corrosion resistance to anodized aluminum alloy. However, hexavalent chromium is highly toxic and carcinogenic to human and the environment. Due to environmental issues and the workers safety, both commercial and military aircraft users are urged to identify chromate free treatments. Thus finding a suitable alternate for chromate based coating with technically equivalent or superior performance is essential.

Few chromate free sealers based on nickel/cobalt acetate, sodium silicate, trivalent chromium and phosphate have been developed but their corrosion inhibition performance is inferior to chromate based coating. Cerium based sealing bath has showed promising improvement in corrosion resistance performance. Nevertheless, the usage of rare earth elements in the bath is not economically viable. In general, based on the sealing bath temperature, the sealing process is classified into high (above 95° C.), medium (between 80-95° C.), low temperature (between 70-80° C.) and ambient temperature (between 25-35° C.) sealing. In high temperature sealing process smutting is one of the major encountered problem which will result in poor paint adhesion. But in low temperature sealing the incorporation of sealing inhibitors into the porous oxide layer may be improper. Hence, a low temperature sealing procedure with effective inhibition can provide a cost effective and energy saving process for anodization. In the present scenario, no adequate hexavalent chromium free coatings are available with equivalent or superior corrosion inhibition along with paint adhesion to that of CAA.

In general, sulphuric acid based anodization (SAA) process is commonly employed as an alternate to conventional chromic acid anodization (CAA). This process gives the thickness of about 10 to 15 microns in 1 h. However, SAA process reduces the fatigue life of the aluminum alloy substrate material. The formed cracks and pores during anodization also reduce the corrosion resistance property of the developed oxide layer.

In another way, the incorporation of tartaric acid/boric acid into sulphuric acid anodization bath has been identified to improve the fatigue property of the anodized oxide layer and which is approximately equivalent to conventional CAA. From the last decade Boeing uses boric-sulphuric acid anodization (BSAA) process along with dilute chromate solution (45-75 ppm of hexavalent chromium) sealing as an alternate to CAA for aircraft application. Similarly, Airbus uses Tartaric-Sulphuric acid anodization (Apticote 300TSA) sealed with either boiling water or Alodine 1200 (hexavalent chromium based).

Present invention relates to a process sealing of anodized high strength aerospace grade aluminum alloy surfaces with chromate free manganese (Mn), molybdenum (Mo) and vanadium (V) oxyanions based solution for increasing the corrosion resistance in external aggressive environment. More specifically, this invention provides a new hexavalent chromium free aqueous based sealing solution for anodized aluminum alloys.

Prior-art search has been made for the anodization and sealing processes for the corrosion protection of aluminum and its alloys in patents as well as non-patents literature. None of the literature resembles the feature disclosed in the present invention. However, following patents and non-patents literature are referred due to their relevance to field of present invention.

Reference may be made to U.S. Pat. No. 5,358,623, wherein a non-chromium sealing bath containing at least 0.15 wt. % of alkali metal permanganate in the pH range of about 4 to 8 and the temperature of about 77° C. to the boiling point of the solution in order to provide a protective coating on aluminum or aluminum alloy. The permanganate treated anodized AA2024 between 88-93° C. provides protection against pitting corrosion in neutral salt spray test for about 336 h. Even though this work is useful considering it is a high temperature sealing process which increases the energy consumption and workers safety parameters and also no study has been carried out on the self-healing protection behaviour of the coating which is essential for the corrosion protection of any mechanical damage of the coating occurs in the field.

Reference may be made to U.S. Pat. No. 20020117236A1, which discloses a room temperature aqueous sealant composition comprising of trivalent chromium salts, alkali metal hexafluorozirconate and alkali metal fluoro-compound in the pH range of about 2.5 to 4.5. It has been mentioned that the trivalent chromium sealing process (TCP) qualifies more than 1000 h of salt spray test and its performance is equivalent to the conventional hexavalent chromium sealing process. However, six months old TCP sealing solution is used for all the experiments and hence, it is a time consuming process for industrial application. Also addition of several inhibitors into sealing bath is not cost effective and also the usage of trivalent chromium does not completely remove the hexavalent chromium from the process. Presence of any oxidizing agent in disposal which can convert the chromium from trivalent to hexavalent state and it becomes toxic for the environment.

Reference may be made to U.S. Pat. No. 6,248,184 B1, in which a sealing solution comprising a dilute solution of rare earth metal salt selected from the group of Ce and Y salts. This is a process which describes when the anodized aluminum or aluminum alloy substrate is exposed in a sealing solution comprised of a dilute solution of rare earth metal (REM) salt. This process produces an effectively sealed corrosion protective anodized surface. This process is an attempt to find an alternative to the commonly employed chromate sealing solution for sulphuric acid anodization (SAA), CAA and Boric-sulphuric acid anodizing (BSAA) processes. Even though the test panels of anodized and REM sealed 6061 and 7075 specimens have been passed 336 h of neutral salt spray test according to ASTM B-117 standard, the process exhibited poor corrosion inhibition performance (two pits per 10 sq. in.) on AA2024 specimen.

Reference may be made to U.S. Pat. No. 20070095436 A1 in which a sealing process has been described by treating the bare/anodized aluminum and its alloys with an acidic solution of water soluble fluorine based metal ion and effective amount of water soluble thickeners. The usage of fluorine in bath is not advisable for disposal of waste water and the workers exposure. Though, it has been claimed that this process improves the corrosion resistance behaviour of AA2024, the results of sealed anodic coatings performance in salt spray test have not been discussed.

Reference may be made to U.S. Pat. No. 6,059,897 where in the process discloses the post sealing anodizing solution comprised of one or more cationic, anionic or non-ionic surfactants. The temperature of the sealing bath has been kept at the temperature between 75° C. and the boiling point of the solution. The pH of the sealing bath is between 0.5 and 2 minutes per micron thickness of the anodic oxide layer and duration of the process is between 5.5 and 8.5 respectively. However, this process is a high temperature sealing process and also the usage of long chain alkyl compounds (surfactants) may reduce the adhesion of the coating for further paint application.

Reference may be made to U.S. Pat. No. 5,954,893 A in which a method has been described for sealing the anodic porous structure by immersing the specimens into a solution or gel comprising a metavanadate ion and followed by the treatment with Ce (III) cation based solution. The effectiveness of this double dip procedure has been further enhanced by boiling water treatment. This process develops a very good corrosion protective coating on 2014 aluminum alloy specimen for up to 336 h of salt spray exposure with no corrosion attack. However, these coated specimens exhibit poor salt fog resistance after 1000 h without further third step treatment either in boiling water or metal ion sealing process. The third sealing step further increases the processing time and cost. Also the concentration of metavanadate and Ce (III) salt solution used in this process are 25 g/l and 10 g/l which may increase the cost of the process.

Reference may be made to U.S. Pat. No. 20020157961A1 in which a method has been described for anodizing a substrate of aluminum or aluminum alloys in Tartaric-Sulphuric acid (TSA) bath for about 30 minutes followed by sealing with conventional sealers for about 45 minutes. This process develops a very good corrosion protective coating on aluminum and its alloys. However, the conventional sealers may be based on either boiling water seal or hexavalent chromium. In this process the corrosion resistance behaviour due to mechanical damage has not been studied. In general, boiling water sealing provides minimum resistance for mechanical damage of the sealed coating and usage of hexavalent chromium is not environment friendly.

The improved corrosion resistance performance of TSA process has been analysed and discussed in different views and this has been described in the Journal of the Corrosion Science 51 (2009) 2034-2042. However, TSA process without post treatment showed poor corrosion inhibition performance for long term application. Therefore, in the above mentioned process the conventional sealers used may be based on either boiling water seal or hexavalent chromium. In this process the corrosion resistance behaviour due to mechanical damage has not been studied. In general, boiling water sealing provides minimum resistance for mechanical damage of the sealed coating and usage of hexavalent chromium is not environment friendly.

As seen from the above referred prior-arts, TSA or any other anodized layers are being post treated with either boiling water or dilute solution of dichromate or Alodine 1200 to achieve long term corrosion protection on high strength aluminum alloys. None of the documents discloses long term corrosion inhibition (>2000 h) for high strength aluminum alloys in chloride ion environment and self-healing protection equivalent to that of CAA. It is to be noted that the self-healing property of the sealed anodized coating is also important for active protection of any mechanical damage in the field applications. None of the documents addresses and provides solution to these problems.

OBJECTIVES OF THE INVENTION

Main objective of present invention is to provide a composition which is capable of effectively sealing an anodized coating developed on high strength corrosion prone aerospace grade aluminum alloy.

Another objective of present invention is to replace the existing toxic hexavalent chromium based sealing solution with an equivalent or better corrosion protective non-chromate seal solution using Mn—Mo/Mn—V oxyanions as inhibitors that are not currently or foreseen to be listed as carcinogenic by the environmental protection agency (EPA).

Yet another objective of present invention is to develop a sealing process completely fluoride ion free chemicals which are not advisable for workers and waste water disposal.

Yet another objective of present invention is to develop a hexavalent chromium free sealed anodic coating with better adhesion for further paint application.

Thus the main aim of present invention is to provide a simple, economic, minimum health risk and highly durable sealing process which include cost effective, relatively abundant inhibitors, environmentally friendly chemicals, low processing temperature (as above mentioned <80° C.) and long term corrosion protection respectively.

Novelty and Inventive Steps

Novelty of present invention lies in providing a cost-effective, adherent and self-healing sealed anodic coating having long term corrosion resistance (>2000 h) for aerospace grade aluminum alloys as an alternative for existing toxic hexavalent chromium based anodic coating.

Above mentioned novelty of present invention has been achieved by incorporating following inventive steps:

1. Anodization of treated substrate in Tartaric-Sulphuric acid electrolyte at current densities between 10 to 30 $mA/cm^2$ for a period of 30 to 120 minutes
2. Use of transition element oxyanions as corrosion inhibitors and alkali metal nitrates as additives in sealing bath.
3. Sealing of anodized substrate by dipping in sealing bath maintained at temperature between 60 to 80° C. and the pH of 7 to 9.

SUMMARY OF THE INVENTION

Accordingly, in a process for the preparation of a corrosion resistant chromium-free sealed anodized coating on aluminum and/or aluminum alloy substrates comprises dipping the said anodized substrate in a mild alkaline sealing bath for a period of 20 to 40 minutes containing at least two water soluble inorganic metal oxyanions as corrosion inhibitors and additives, wherein said bath is maintained at temperature between 60 to 80° C. and pH of 7 to 9 for the sealing of anodized substrate.

In an embodiment, corrosion inhibitors in sealing bath are selected from the group 5, 6 and 7 of d-block transition elements of periodic table.

In yet another embodiment, additives in sealing bath are nitrogen containing inorganic compounds preferably metal nitrates of lithium, sodium or potassium.

In yet another embodiment, the first water soluble transition element is Mn, Mo, V, Ti, Zr, W salts preferably a Mn based oxyanion.

In yet another embodiment, the second water soluble transition element is Mn, Nb, Ta, Mo, V, W salts, preferably Mo or V based oxyanion.

In yet another embodiment, sealing bath contains Mn oxyanion in the range of 2 to 17 g/l, Mo/V oxyanion in the range of 1 to 10 g/l and alkali metal nitrates in the range of 3 to 8 g/l.

In yet another embodiment, preparation of anodized substrate comprises the steps of:

a. cleaning of substrate by wiping with acetone or ultrasonication;
b. rinsing of cleaned substrate;
c. etching of cleaned substrate in sodium hydroxide solution having concentration between 0.3 to 1 molar;
d. rinsing of etched substrate;
e. deoxidizing the treated substrate as obtained in step (d) in 1:1 aqueous solution of nitric acid followed by rinsing; and,
f. developing an anodic oxide layer on substrate by anodization in Tartaric-Sulphuric acid electrolyte at current densities between 10 to 30 $mA/cm^2$ for a period of 30 to 120 minutes followed by rinsing In yet another embodiment, rinsing is carried out preferably with distilled water.

In yet another embodiment, the Tartaric-Sulphuric acid anodization is carried out in either sweep or constant current density mode.

DETAIL DESCRIPTION OF THE INVENTION

Present invention relates to a novel chromium-free sealing composition and the process for preparing corrosion resistant coating for anodized aluminum and aluminum alloys. The metal panels used in the tests were aluminium alloy panels of unclad 2024-T3 aerospace quality sheet. The nominal composition of the alloy (in weight percent) was 5.0% copper, 1.5% magnesium, 0.7% manganese, 0.4% iron, 0.1% silicon and the remainder being aluminium. The present invention provides a process and composition for sealing anodic oxide developed on aluminum and high strength aluminum alloys wherein the composition of the invention is an aqueous solution containing either the mixture of Mn and Mo or Mn and V oxyanions. This process includes the following steps:

(1) Developing an anodic oxide layer by anodization process on aluminum or aluminum alloy substrate
(2) Providing a sealing solution comprising of a mild alkaline solution containing at least two water soluble non chromium metal oxyanions and alkali metal ion based nitrates
(3) Contacting the substrate with sealing solution for sufficient amount of time to seal the developed anodic oxide layer In producing a corrosion-resistant coating on an aluminum surface, generally the surface should be free of soil and oxides contamination which interfere the further coating process. The surface can be cleaned by any convenient method available in the market. Subsequent to the cleaning and rinsing, the cleaned specimen has to be anodized in suitable electrolyte. Preferably, Tartaric-Sulphuric acid anodization experiment for at least 30 minutes to 45 minutes. Most preferably, 50 to 60 minutes. Then the anodized aluminum surface is treated with the Mn and Mo/V oxyanion based sealing solution of this invention.

Various methods of contacting the anodized specimen with sealing solution such as by spraying, dipping, brushing art is acceptable most preferably dipping process. In this process the anodized surface is contacted with an aqueous solution containing soluble Mn and Mo/V oxyanions for at least 15 minutes, preferably 20 to 40 minutes. In most cases, excellent results can be achieved for about 30 to 40 minutes.

The Mn and Mo/V oxyanions are selected from alkali metal source (potassium, sodium or lithium). The preferred alkali metal source is sodium or potassium. Most preferably, the solution consists essentially of potassium permanganate and sodium metavanadate. The composition of this bath includes alkali metal Mn oxyanion from 2 to 17 g/l and alkali metal Mo/V oxyanion from 1 to 10 g/l. Preferably Mn oxyanion of about 8 to 12 g/l and Mo/V oxyanion of about 4 to 7 g/l.

Further the process of this sealing solution also contains alkali metal nitrates in the range of 3 to 8 g/l. The preferred alkali metal source is lithium (or) sodium (or) potassium. The alkali metal nitrates plays dual role in sealing process. The first reason for the addition of alkali/alkaline earth metal salts into the sealing is it improves the sealing quality and then the presence of nitrates acts as an activator for the sealing process and results in reduced processing time. In particular, the addition of highly soluble lithium ions favors the formation of insoluble alkali metal aluminum oxide complexes. The mixture of above mentioned alkali metal nitrates can also be used to achieve better sealing quality.

The sealing bath has a pH range of between 7 and 10, most preferably between 8 and 9. The temperature of the sealing bath is at least 60° C., more preferably from 70 to 75° C. The anodized specimens may be contacted with the sealing solution by immersion of about 15 to 40 minutes.

The surface treated with Mn and Mo/V oxyanion containing solution as per the above mentioned procedure has been exposed to 5% neutral salt spray test according to ASTM B-117 Standard. The sealed specimen has exhibited improved corrosion resistance performance during salt spray exposure. In order to understand the self-healing behaviour of this coating, a scribe mark has also been made on each panel and then exposed in salt spray chamber for minimum 500 h as per the above mentioned procedure.

On the Mn and Mo/V oxyanion sealed anodic oxide coated specimen, it has been identified that the Mn oxyanion forms an insoluble barrier oxide layer over the anodized aluminum surface. In the presence of Mo/V oxyanion, Mn oxyanions are incorporated along with the molybdate/vanadate oligomers during the sealing process on the alumina of the anodized aluminum surface. Molybdate/vanadate oligomers provide a compact polymeric network and which impede the penetration of corrosive species. Both these oxide layers formed by Mn and Mo/V oxyanions are found to be passive barrier during the corrosion process. It has also been identified that the presence of higher oxidation state soluble species of both Mn and Mo/V oxyanions in the sealed oxide layer. When there is a mechanical damage in the coating both these higher oxidation state soluble species migrates towards the corrosion area and simultaneously forms a passive layer. This has been identified as active corrosion inhibition (self-healing) performance of this developed coating.

This coating provides excellent corrosion resistance and paint adhesion for anodized high strength and high copper content and high corrosion prone aluminum alloy. This process can provide corrosion protection of greater than 2000 h of neutral salt spray exposure.

The following examples are given by way of illustrations and therefore, should not be construed to limit the scope of the present invention.

Example 1

Samples (1.5 in.×5 in.) of AA2024 were coated as per the following procedure:

1. Each sample was cleaned with acetone and then ultrasonicated in the same solution for about 10 to 15 minutes. Each was then immersed in hot sodium hydroxide solution and finally treated with nitric acid in order to remove the residual organic and inorganic impurities from the surface. The specimens were washed with distilled water for about 2 minutes after every treatment.
2. Each cleaned specimen was then anodized in 2.5% sulphuric acid and 80 g/l tartaric acid for about 120 minutes with constant current density of about 20 mA/cm$^2$.
3. The anodized specimen then exposed to salt fog corrosion testing according to ASTM B117.
4. In order to check the self-healing corrosion resistance property, the freshly anodized specimen was mechanically damaged (cross-hatched) and then subjected for salt fog corrosion testing for about 500 h.
5. In order to check the adhesion performance with paint, the anodized specimen was then coated with volatile organic compound (VOC) compliant epoxy-polyamide primer. Then adhesion test was carried out after complete curing.
6. The properties of this specimen are listed in Table I.

As seen from the Table 1, the coated specimen showed the formation of pit within 50 hrs of salt spray exposure and completely corroded in cross hatched area.

Example 2

Samples (1.5 in.×5 in.) of AA2024 were coated as per the following procedure:

1. Each sample was cleaned with acetone and then ultrasonicated in the same solution for about 10 to 15 minutes. Each was then immersed in hot sodium hydroxide solution and finally treated with nitric acid in order to remove the residual organic and inorganic impurities from the surface. The specimens were washed with distilled water for about 2 minutes after every treatment.
2. Each cleaned specimen was then anodized in 2.5% sulphuric acid and 80 g/l tartaric acid for about 120 minutes with constant current density of about 20 mA/cm$^2$.
3. Each anodized specimen was then sealed in boiling water (conventional sealing for comparison) by immersion for about 30 minutes. The solution temperature was maintained at 95-100° C.
4. The boiling water sealed anodized specimen was then exposed to salt fog corrosion testing according to ASTM B117.
5. In order to check the self-healing corrosion resistance property, the freshly prepared specimen was mechanically damaged (cross-hatched) and then exposed to salt fog corrosion testing for about 500 h.
6. In order to check the adhesion performance with paint, the anodized specimen was then coated with volatile organic compound (VOC) compliant epoxy-polyamide primer. Then adhesion test was carried out after complete curing.
7. The properties of this specimen are listed in Table I.

It is observed from the Table 1 that anodized alloy sealed with boiling water exhibited the formation of pit within 400 hrs of salt spray exposure and found completely corroded in cross hatched area.

Example 3

Samples (1.5 in.×5 in.) of AA2024 were coated as per the following procedure:

1. Each sample was cleaned with acetone and then ultrasonicated in the same solution for about 10 to 15 minutes. Each was then immersed in hot sodium hydroxide solution and finally treated with nitric acid in order to remove the residual organic and inorganic impurities from the surface. The specimens were washed with distilled water for about 2 minutes after every treatment.
2. Each cleaned specimen was then anodized in 2.5% sulphuric acid and 80 g/l tartaric acid for about 120 minutes with constant current density of about 20 mA/cm$^2$.
3. Each anodized specimen was then sealed in a sealing solution containing 5 g/l of potassium permanganate, 2.5 g/l of sodium vanadate, 5 g/l of sodium nitrate and 4 g/l of lithium nitrate for a period of 30 minutes. The solution temperature was maintained at 70° C.
4. Then coated specimens were removed from the sealing solution followed by washed with distilled water for about 2 minutes and then air-dried.
5. This sealed anodized specimen was then exposed to salt fog corrosion testing according to ASTM B117.
6. In order to check the self-healing corrosion resistance property, the freshly prepared specimen was mechanically damaged (cross-hatched) and then exposed to salt fog corrosion testing for about 500 h.
7. In order to check the adhesion performance with paint, the anodized specimen was then coated with volatile organic compound (VOC) compliant epoxy-polyamide primer. Then adhesion test was carried out after complete curing.

8. The properties of this specimen are listed in Table I.

Anodized alloy sealed with Mn—V oxyanion showed no formation of pits even after 2000 hrs of salt spray exposure and also displayed no corrosion in cross hatched area.

Example 4

Samples (1.5 in.×5 in.) of AA2024 were coated as per the following procedure:

1. Each sample was cleaned with acetone and then ultrasonicated in the same solution for about 10 to 15 minutes. Each was then immersed in hot sodium hydroxide solution and finally treated with nitric acid in order to remove the residual organic and inorganic impurities from the surface. The specimens were washed with distilled water for about 2 minutes after every treatment.
2. Each cleaned specimen was then anodized in 2.5% sulphuric acid and 80 g/l tartaric acid for about 60 minutes with constant current density of about 20 $mA/cm^2$.
3. Each anodized specimen was then sealed in a sealing solution containing immersed in 5 g/l of potassium permanganate, 2.5 g/l of sodium molybdate, 5 g/l of sodium nitrate and 4 g/l of lithium nitrate for a period of 30 minutes. The solution temperature was maintained at 75° C.
4. Then coated specimens were removed from the sealing solution followed by washed with distilled water for about 2 minutes and then air-dried.
5. This sealed anodized specimen was then exposed to salt fog corrosion testing according to ASTM B117.
6. In order to check the self-healing corrosion resistance property, the freshly prepared specimen was mechanically damaged (cross-hatched) and then exposed to salt fog corrosion testing for about 500 h.
7. In order to check the adhesion performance with paint, the anodized specimen was then coated with volatile organic compound (VOC) compliant epoxy-polyamide primer. Then adhesion test was carried out after complete curing.
8. The properties of this specimen are listed in Table I.

Anodized alloy sealed with Mn—Mo oxyanion withstands the salt spray test up to 2000 hrs and also displayed no corrosion in cross hatched area.

Example 5

To compare the performance of coatings of present invention with conventional method, Samples (1.5 in.×5 in.) of AA2024 were coated with the following procedure:

1. Each sample was cleaned with acetone and then ultrasonicated in the same solution for about 10 to 15 minutes. Each was then immersed in hot sodium hydroxide solution and finally treated with nitric acid in order to remove the residual organic and inorganic impurities from the surface. The specimens were washed with distilled water for about 2 minutes after every treatment.
2. Each cleaned specimen was then anodized in an aqueous acidic solution containing 65 g/l of chromic acid and 0.4 g/l of sodium sulphate. The temperature of the bath was maintained between 38 and 40° C. During anodization process the electrical voltage was increased from 0 V to 40 V at a rate of 5 V/min. Then the final voltage was maintained for 45 minutes.
3. Each anodized specimen was then sealed in boiling water by immersion for about 30 minutes. The solution temperature was maintained at 95-100° C.
4. This sealed anodized specimen was then exposed to salt fog corrosion testing according to ASTM B117.
5. In order to check the self-healing corrosion resistance property, the freshly prepared specimen was mechanically damaged (cross-hatched) and then exposed to salt fog corrosion testing for about 500 h.
6. In order to check the adhesion performance with paint, the anodized specimen was then coated with volatile organic compound (VOC) compliant epoxy-polyamide primer. Then adhesion test was carried out after complete curing.
7. The properties of this specimen are listed in Table I.

As seen from Table 1, coatings prepared using the above conventional method showed corrosion in cross hatched area.

From the above examples, it is observed that chromate free sealed oxide layers of present invention is capable of withstanding about 2000 h of continuous salt spray exposure and also exhibited self-healing behavior in corrosive environment. Coating also showed excellent paint adhesion rating which is at par with conventional method. This effect is due to anodization of treated substrate in Tartaric-Sulphuric acid electrolyte followed by sealing using transition element oxyanions as corrosion inhibitors and alkali metal nitrates as additives in sealing bath. Thus present invention qualifies the novelty and is an alternative for the coating obtained by conventional toxic chromic acid anodization process.

Main advantages of the present invention are as follows:

1. The present invention is a simple process and completely eliminates the toxicity of hexavalent chromium compositions generally used for this purpose and therefore it is more environmental friendly.
2. This process reduces the processing temperature than the conventionally used boiling water sealing or hexavalent chromium based sealing or other non-chromium based sealing processes.
3. This process is based on relatively abundant and low cost chemicals and hence it is highly economic.
4. Our example show this process provides highly durable corrosion resistant coating (greater than 2000 h of neutral salt spray test) on high strength aerospace grade aluminum alloy with improved adhesion and self-healing properties.

We claim:

1. An improved process for the manufacture of a corrosion resistant, sealed, anodized, coated metal or metal alloy substrate, the process comprising the steps of:

(a) cleaning a metal or metal alloy substrate by wiping with acetone or ultrasonication;

(b) rinsing the cleaned substrate of (a) with distilled water;

(c) etching the rinsed substrate of (b) in sodium hydroxide solution having a concentration between 0.3 to 1 molar;

(d) rinsing the etched substrate of (c) with distilled water;

(e) deoxidizing the rinsed substrate of (d) in a 1:1 aqueous solution of nitric acid followed by rinsing with distilled water;

(f) forming an anodic oxide coating on the deoxidized substrate of (e) by anodization;

(g) sealing the anodic oxide coating on the substrate of (f) in a sealing bath containing a solution comprising as corrosion inhibitors, a combination of manganese oxyanions in the range of 2 to 17 g/l and vanadium oxyanions in the range of 1 to 10 g/l, and as an additive, one or more alkali metal nitrates in the range of 3 to 8 g/l, followed by rinsing with distilled water; and (h) air drying the substrate having the sealed anodic oxide coating of (g) to form the corrosion resistant sealed, anodized, coated substrate, wherein the anodization in (f) is performed in an 8 wt % tartaric acid-2.5 wt % sulphuric acid electrolyte at a temperature in the range of 28-30° C. and with current densities between 10 to 30 mA/cm$^2$ for a period of 30 to 120 minutes, and wherein the sealing in (g) is performed by dipping the substrate with the anodic oxide coating from (f) in the sealing bath containing the solution comprising as corrosion inhibitors, a combination of manganese oxyanions in the range of 2 to 17 g/l and vanadium oxyanions in the range of 1 to 10 g/l, and as an additive, one or more alkali metal nitrates in the range of 3 to 8 g/l, for a period from above 20 up to 40 minutes at a pH in the range 7 to 9 and at a temperature between 60 and 80° C.

2. The improved process of claim 1, wherein in (f) the anodization is performed in the tartaric sulphuric acid electrolyte in either a sweep or a constant current density mode.

3. The improved process of claim 1, wherein the corrosion resistant, sealed, anodic oxide coating has a thickness in the range of 3 to 12 μm, salt spray resistance of >336 h, adhesion with epoxy primer of >4B and electrical breakdown voltage of >50 V.

4. The improved process of claim 1, wherein in (g) the alkali metal nitrates are selected from the group consisting of nitrates of lithium salts, sodium salts, and potassium salts.

* * * * *